US011486239B2

(12) United States Patent
Al-Gouhi

(10) Patent No.: US 11,486,239 B2
(45) **Date of Patent: *Nov. 1, 2022**

(54) DOWNHOLE WATER REMOVAL TOOL

(71) Applicant: Saudi Arabian Oil Company, Dhahran (SA)

(72) Inventor: Alwaleed Abdullah Al-Gouhi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 17/140,010

(22) Filed: Jan. 1, 2021

(65) Prior Publication Data

US 2022/0213768 A1 Jul. 7, 2022

(51) Int. Cl.

| | |
|---|---|
| ***E21B 43/12*** | (2006.01) |
| ***E21B 43/38*** | (2006.01) |
| ***E21B 47/047*** | (2012.01) |
| ***E21B 43/08*** | (2006.01) |
| *F04D 13/10* | (2006.01) |

(52) U.S. Cl.

CPC ..... *E21B 43/13* (2020.05); *E21B 43/38* (2013.01); *E21B 47/047* (2020.05); *E21B 43/086* (2013.01); *F04D 13/10* (2013.01)

(58) Field of Classification Search

CPC ..... E21B 43/38; E21B 43/385

See application file for complete search history.

(56) References Cited

U.S. PATENT DOCUMENTS

| | | | | |
|---|---|---|---|---|
| 10,669,814 | B2 | 6/2020 | Batarseh | |
| 10,844,700 | B2 | 11/2020 | Al-Gouhi | |
| 2009/0173667 | A1 * | 7/2009 | Varma | E21B 43/2401 196/46 |
| 2010/0193193 | A1 | 8/2010 | Wagg | |
| 2018/0283154 | A1 | 10/2018 | De | |
| 2020/0003035 | A1 * | 1/2020 | Al-Gouhi | E21B 43/128 |

OTHER PUBLICATIONS

Wikipedia.com [online], "Downhole oil-water separation technology," available on or before Aug. 31, 2012, via Internet Archive: Wayback Machine URL <https://web.archive.org/web/20120831152603/https://en.wikipedia.org/wiki/Downhole_oil%E2%80%93water_separation_technology>, retrieved on Feb. 4, 2021 from URL <https://en.wikipedia.org/wiki/Downhole_oil%E2%80%93water_separation_technology>, 2 pages.

* cited by examiner

*Primary Examiner* — Robert E Fuller

(74) *Attorney, Agent, or Firm* — Fish & Richardson P.C.

(57) ABSTRACT

In some implementations, a method involves determining a level of accumulation of a hydrocarbon-water emulsion in an annulus of a wellbore. The method further involves based on the level of accumulation, determining an operating setting of a hydrocarbon-water separator and operating the hydrocarbon-water separator at the operating setting, where the hydrocarbon-water separator separates the hydrocarbon-water emulsion into water and a hydrocarbon fluid. Further, the method involves activating, in response to a first sensor detecting a first water level in the annulus, a pump that pumps the water from the annulus into a water zone below the wellbore. Yet further, the method involves deactivating the pump in response to a second sensor detecting a second water level in the annulus, where the second sensor is located below the first sensor.

19 Claims, 3 Drawing Sheets

DOWNHOLE WATER REMOVAL TOOL

TECHNICAL FIELD

This description relates to a downhole water removal tool.

BACKGROUND

Production of waste water with oil and gas is problem for the oil and gas industry. During the production of hydrocarbons, such as oil or gas, the hydrocarbons sometimes also include water. The water produced by wells can originate from the hydrocarbon bearing zones, from aquifers that are near to the hydrocarbon bearing zones, or from water that is injected downhole. Various chemicals are sometimes also mixed with the injection water to improve the reservoir sweep efficiency. When produced at the surface, this hydrocarbon-water emulsion causes issues, such as environmental issues.

SUMMARY

In existing solutions, hydrocarbons and water are produced and separated at the surface. In wells that are drilled in mature reservoirs, the water-cut can become extremely high, reducing the economic viability of the well, sometimes resulting in abandonment of wells. Other existing solutions include blocking the water encroachment by mechanical means, chemicals, controlled production, or some combination of these approaches. Such solutions, however, often adversely compromise the oil production capacity of wells.

This disclosure describes a downhole hydrocarbon-water separation tool ("downhole tool") that performs the hydrocarbon-water separation downhole. The downhole tool includes a hydrocarbon-water separation system that includes at least one of a gravity separator, a heating element, or an emulsifier injection line. Once the hydrocarbon-water emulsion is separated into a hydrocarbon fluid and water, the downhole tool directs the flow of the hydrocarbon fluid through a wellbore, where the hydrocarbon fluid is carried by the wellbore to the surface. The downhole tool also includes an injection system that injects the water into a water zone, for example, beneath the hydrocarbon zone.

Aspects of the subject matter described in this specification may be embodied in methods that include the actions of: determining a level of accumulation of a hydrocarbon-water emulsion in an annulus of a wellbore; based on the level of accumulation, determining an operating setting of a hydrocarbon-water separator and operating the hydrocarbon-water separator at the operating setting, where the hydrocarbon-water separator separates the hydrocarbon-water emulsion into water and a hydrocarbon fluid; activating, in response to a first sensor detecting a first water level in the annulus, a pump that pumps the water from the annulus into a water zone below the wellbore; and deactivating the pump in response to a second sensor detecting a second water level in the annulus, where the second sensor is located below the first sensor.

The previously-described implementation is applicable using a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium. These and other embodiments may each optionally include one or more of the following features.

In some implementations, the hydrocarbon-water separator includes a heating element, and the operating setting is a temperature of the heating element.

In some implementations, the hydrocarbon-water separator includes a heating element, and the operating setting is a length of time that the heating element is turned on.

In some implementations, the hydrocarbon-water separator includes an emulsion injection line, and the operating setting comprises a quantity of chemicals injected by the emulsion injection line. The emulsion injection line may run to a tank on the surface that includes the chemicals, and can be controlled to intermittently or continuously inject chemicals, such as demulsifiers and flocculants.

In some implementations, determining the operating setting of the hydrocarbon-water separator is further based on a rate of separation of the hydrocarbon-water emulsion.

In some implementations, the rate of separation is calculated based on at least one of a quantity of emulsion that enters the annulus and a quantity of hydrocarbon fluid that reaches the surface during a given time period.

In some implementations, the pump comprises an electric submersible pump.

The subject matter described in this specification can be implemented in particular implementations so as to realize one or more of the following advantages. The disclosed downhole tool can eliminate, minimize, or otherwise reduce the amount of formation water produced at the surface of the wellbore along with the hydrocarbon fluid. In some instances, the downhole tool can produce the hydrocarbon fluid at the surface independent of pumps at the surface, which are typically needed for water separation. In doing so, the downhole tool can prevent or otherwise reduce the production of water at the surface and hydrocarbon fluid passing to the water zone.

The details of one or more embodiments of these systems and methods are set forth in the accompanying drawings and description below. Other features, objects, and advantages of these systems and methods will be apparent from the description, drawings, and claims.

BRIEF DESCRIPTION OF THE DRAWINGS

Like reference symbols in the various drawings indicate like elements.

DETAILED DESCRIPTION

The present disclosure describes a downhole tool that can be used in a wellbore system that receives a hydrocarbon-water emulsion from a hydrocarbon reservoir in a subterranean formation. In some embodiments, the flow of the hydrocarbon-water emulsion is directed to accumulate in a compartment of a hydrocarbon-water separator. The hydrocarbon-water separator is configured to separate the hydrocarbon-water emulsion into water and a hydrocarbon fluid. The hydrocarbon fluid flows into a production tubing that carries the hydrocarbon to the surface. The downhole tool also includes a fluid injector that is configured to inject the water into a water zone (for example, beneath the wellbore system). The fluid injector includes a pump that is controlled by sensors that activate/deactivate the pump based on the water level in the compartment.

In some examples, the wellbore system includes a primary wellbore (for example, a vertical wellbore) and horizontal wellbore emanating from the primary wellbore. Further, the horizontal wellbore carries the hydrocarbon-water emulsion from the reservoir to the primary wellbore. In these examples, the downhole tool is placed in proximity of the primary wellbore (for example, in an area where the horizontal wellbore meets the primary wellbore). The emulsion flow is directed to an annulus of the primary wellbore where it accumulates. The hydrocarbon-water separator separates the accumulated emulsion into water and a hydrocarbon fluid. The hydrocarbon fluid is directed to flow to a production tubing of the primary wellbore, for example, through perforations in the production tubing, and is carried to the surface.

Furthermore, the water injector injects the water into the reservoir water zone. Specifically, once the water level in the annulus reaches a first water level, a first sensor in the annulus detects the first water level and responsively activates a pump to inject the water into the reservoir water zone. Once the water level in the annulus falls to a second water level below the first water level, a second sensor in the annulus detects the second water level and responsively deactivates the pump. In doing so, the downhole tool can eliminate, minimize, or otherwise reduce the amount of formation water produced at the surface of the wellbore along with the hydrocarbon fluid.

Figure 1:
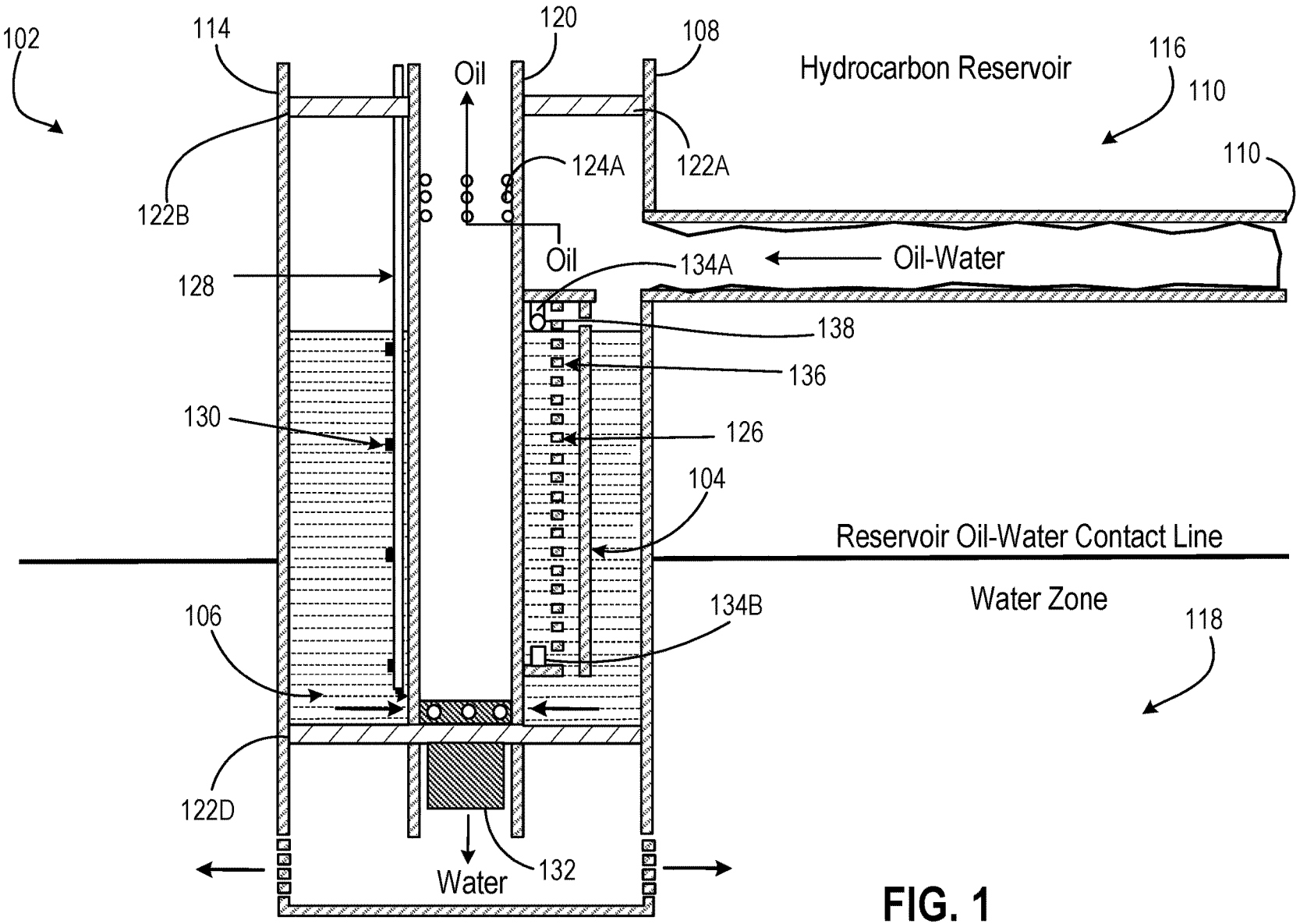
FIG. 1 is a schematic illustration of a downhole tool that is deployed in a wellbore system, according to some implementations of the present disclosure.

FIG. 1 illustrates a downhole tool 102 deployed in a wellbore system, according to some implementations. As explained in more detail below, the downhole tool 102 is installed downhole in the wellbore system and is configured to separate a hydrocarbon fluid and water in the wellbore. The wellbore system brings the hydrocarbon fluid to the surface and the water is pumped into a water zone 118 (or an injection formation). As also described in more detail below, the downhole tool 102 includes a hydrocarbon-water separator 104 and a water injector 106. The hydrocarbon-water separator 104 is configured to separate the hydrocarbon-water emulsion, and the water injector 106 is configured to inject the water into the water zone 118.

In the example of FIG. 1, the wellbore system includes a primary wellbore 108 and a horizontal wellbore 110 in a subterranean formation. Although not shown, a drilling assembly deployed on the surface can form the wellbores prior to running the downhole tool 102 into the primary wellbore 108 to a particular location in the subterranean formation. The subterranean formation includes a hydrocarbon reservoir 116 and a water zone 118 that meet at a contact line. In some examples, the wellbore system is deployed in a body of water rather than a terranean surface. For instance, the terranean surface may be an ocean, gulf, sea, or any other body of water under which hydrocarbon-bearing formations may be found. Reference to the terranean surface includes both land and water surfaces and contemplates forming and developing one or more wellbore systems from either or both locations.

In some embodiments, the wellbores are cased with one or more casings such as casing 114. In some examples, the horizontal wellbore 110 is offset from the primary wellbore 108 (which may, for example, be a vertical or slant wellbore). In other examples, the wellbore system includes a stepped wellbore such that a portion is drilled vertically downward and then curved to a substantially horizontal wellbore portion. Additional substantially vertical and horizontal wellbore portions can be added according to, for example, the type of terranean surface, the depth of one or more target subterranean formations, the depth of one or more productive subterranean formations, among other criteria.

As illustrated in FIG. 1, the primary wellbore 108 includes a production tubing 120 that is operable to convey (for example, run in, or pull out or both) the downhole tool 102 into the wellbore. In some embodiments, the production tubing 120 is a tubular production string made up of multiple tubing joints. For example, a tubular production string (also known as a production casing) includes sections of steel pipe, which are threaded so that they can interlock together. In other embodiments, the production tubing 120 is a coiled tubing. Further, in some cases, a wireline or slickline conveyance (not shown) is communicably coupled to the downhole tool 102.

As also illustrated in FIG. 1, the primary wellbore also includes upper seals 122*a*, 122*b* and lower seals 122*c*, 122*d*. The seals are configured to form a seal between the production tubing 120 and the casing 114. The seals can be packers, such as inflatable packers or mechanical packers. In some examples, upper seals 122*a*, 122*b* are separated from the lower seals 122*c*, 122*d* by 50 feet (ft), 100 ft, 150 ft, or greater. When sealed, the seals, the production tubing 120, and the casing 114 can form an annulus 112 that functions as a receptacle for the hydrocarbon-water emulsion.

In some embodiments, the production tubing 120 includes upper openings 124*a* and lower openings 124*b* that are longitudinally separated. As shown in FIG. 1, the lower openings 124*b* are vertically lower than the upper openings 124*a*. The upper openings 124*a*, the lower openings 124*b*, or both can be arranged randomly, in a pattern, or a combination of both. In some implementations, the upper openings 124*a*, the lower openings 124*b*, or both can be holes, slots, other appropriates shapes, or a combination thereof without departing from the scope of the disclosure. As described in more detail below, the upper openings 124*a* direct the flow of a hydrocarbon fluid to the production tubing 120, which then carries the hydrocarbon fluid to the surface. Further, the lower openings 124*b* direct the flow of water to a pump that injects the water into the water zone 118.

In some embodiments, the horizontal wellbore 110 produces a hydrocarbon-water emulsion from the hydrocarbon reservoir 116. As shown in FIG. 1, the horizontal wellbore 110 carries the hydrocarbon-water emulsion to the primary wellbore 108. In some examples, the flow of the hydrocarbon-water emulsion is directed to a compartment of the hydrocarbon-water separator 104. In one example, the compartment is the annulus of the primary wellbore 108. In another example, the compartment is separate from the annulus of the primary wellbore 108 (for example, a separate compartment disposed within or near the annulus).

Once the hydrocarbon-water emulsion is in the compartment, the hydrocarbon-water emulsion settles into a non-turbulent state, which is a state in which the emulsion is not agitated. In this state, the hydrocarbon-water emulsion is separated by gravity. Specifically, due to the hydrocarbon fluid having a lower density than water, the force of gravity separates the emulsion by causing the hydrocarbon fluid to rise to the top of the compartment and the water to settle to the bottom of the compartment. The quantity of time that the fluid is in the non-turbulent state, and thus, the quantity of time that the hydrocarbon-water emulsion is being separated is referred to as retention time. The longer the retention time, the greater the degree of separation of the water and hydrocarbon fluids. However, a long retention time can cause inefficiencies such as delayed production.

In some embodiments, the hydrocarbon-water separator 104 may additionally include one or more components that enhance the separation (for example, by speeding up the separation and reducing retention time). In one example, the hydrocarbon-water separator 104 includes a heating element 126 (for example, a heating coil) that heats the emulsion to an effective separation temperature. The effective separation temperature is a temperature at which the hydrocarbon-water interfacial films are destabilized, which in turn, enhances the separation between the hydrocarbon and water. In some examples, the heating element is periodically turned on and off. For instance, the length of time that the heating element is turned on depends on an accumulation of emulsion in the compartment, a rate or speed of the separation, or both. As described below, the rate or speed of separation can be determined based on an quantity of emulsion that enters the annulus and a length of time that the pump of the water injector is turned on.

In another example, the hydrocarbon-water separator 104 includes a demulsifier injection line 128 that is configured to use jets 130 to inject demulsifiers, flocculants, or both into the compartment. Demulsifiers are compounds that, when added to the hydrocarbon-water emulsion, travel to the interfacial films rupture or weaken the rigid film, thereby enhancing water droplet coalescence. Example demulsifiers include copolymers, resins, alkoxylates, and polyethers. Flocculants are chemicals that cause a dispersed colloidal system (that is, the emulsion) to coagulate and form flocs. Example flocculants include multivalent cations (for example, calcium, magnesium and aluminum), or long-chain polymers. In some examples, an quantity of chemicals injected into the compartment depends on an accumulation of emulsion in the compartment, the rate or speed of the separation, or both.

Once the hydrocarbon-water separator 104 separates the hydrocarbon-water emulsion, the hydrocarbon fluid, which rises to the top of the compartment, flows through the upper openings 124*a* into the production tubing 120 where it is carried to the terranean surface. The water, on the other hand, remains in the compartment and settles below the hydrocarbon fluid.

In some embodiments, the water injector 106 is configured to pump the water from the compartment into a water zone 118, for example, below the primary wellbore 108. In an example, the water injector 106 includes an electric submersible pump (ESP) 132, an upper sensor 134*a*, and a lower sensor 134*b*. In some implementations, the ESP 132 includes one or more inlets that are aligned with the lower openings 124*b*. The ESP 132 can inject the water into the water zone 118 intermittently or continuously. In regards to intermittent rates, the volume of injected water can be based on the largest possible caging size, the smallest possible production tubing size, the maximum possible separation between the two sensors, as well as other appropriate parameters.

In some embodiments, the upper sensor 134*a* and the lower sensor 134*b* detect the water level and turns the ESP 132 on and off. The lower sensor 134*b* is positioned above the lower openings 124*b* to shut off the ESP 132 before the water level is below the lower openings. This standoff distance assists in preventing hydrocarbon fluid from leaking into the pump intake or opening. The upper sensor 134*a* is located below opening of the horizontal wellbore 110 to turn on the ESP 132 before the water level rises above the lip of the opening.

In some examples, the upper sensor 134*a* and the lower sensor 134*b* detect a water level when an object 138 floating on a surface of the water contacts either the upper sensor 134*a* or the lower sensor 134*b*. For example, when the upper sensor 134*a* detects contact with the floating object, the upper sensor 134*a* signals the ESP 132 to turn on. And when the lower sensor 134*b* detects contact with the floating object, the lower sensor 134*b* signals the ESP 134 to turn off. In doing so, the downhole tool 102 can prevent or otherwise reduce the production of water at the surface and hydrocarbon fluid passing to the water zone 118. In some examples, the floatable object, the first sensor, and the second sensor are located within an inner volume of a porous housing. The porous housing can be, for example, a side-perforated pocket 136.

In some embodiments, the downhole tool 102 includes a controller (not illustrated in FIG. 1). The controller can, for example, be a computer system similar to or the same as the computer system 300 of FIG. 3. The controller can control the hydrocarbon-water separator 104, the water injector 106, or both. As an example, the controller controls the heating element 126 by setting a temperature of the heating element 126 or turning the heating element 126 on or off. The temperature of the heating element 126 can depend on several factors, including a level of accumulation of the hydrocarbon-water emulsion in the compartment (for example, determined using sensors in the compartment), the chemical and physical properties of the hydrocarbon-water emulsion, and the rate of separation of the hydrocarbon-water emulsion. In one implementation, the rate of separation of the hydrocarbon-water emulsion can be calculated based on a quantity of emulsion that enters the annulus (for example, determined using a flow sensor) and a quantity of hydrocarbon fluid that is reaching the surface during a given time period. Further, the length of time that the heating element 126 is turned on depends on several factors, including the accumulation of the hydrocarbon-water emulsion and the rate of separation of the hydrocarbon-water emulsion.

As another example, the controller controls the emulsifier injection line 128 by determining a quantity of chemicals (for example, demulsifiers or flocculants) to be injected. The quantity of chemicals depends on several factors including the level of accumulation of the hydrocarbon-water emulsion in the compartment, the chemical and physical properties of the hydrocarbon-water emulsion, and the rate of separation of the hydrocarbon-water emulsion. As yet another example, the controller controls the water injector by turning the ESP 132 on or off. In this example, the controller receives signals from the upper sensor 134*a* and the lower sensor 134*b*, and controls the ESP 132 based on the received signals.

Figure 2:
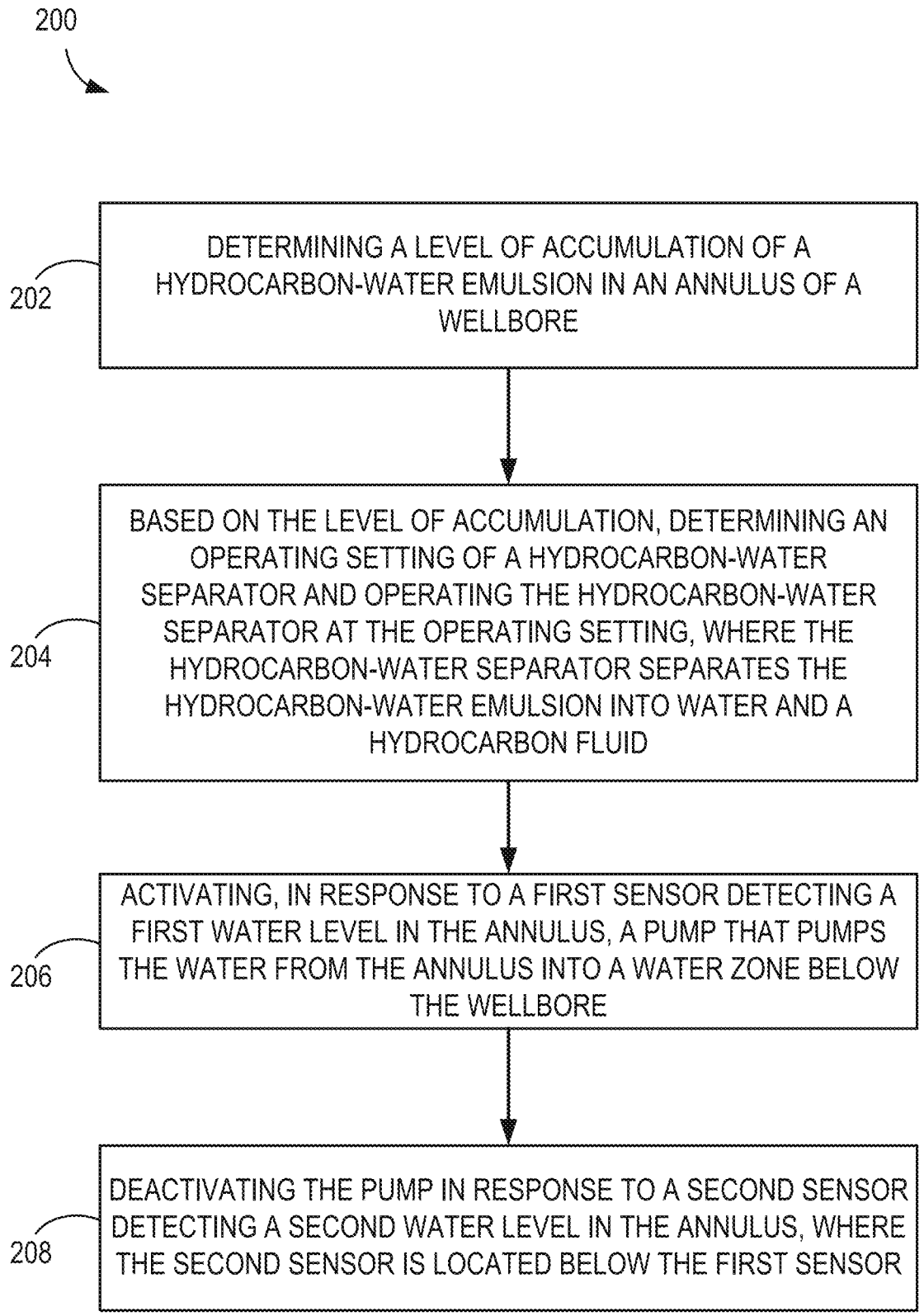
FIG. 2 is a flow chart illustrating an example method, according to some implementations of the present disclosure.

FIG. 2 illustrates a flowchart of an example method 200, according to some implementations. For clarity of presentation, the description that follows generally describes the method 200 in the context of the other figures in this description. For example, the method 300 can be performed by the computing system 300 shown in FIG. 3. However, it will be understood that the method 200 can be performed, for example, by any suitable system, environment, software, and hardware, or a combination of systems, environments, software, and hardware, as appropriate. In some implementations, various steps of the method 200 can be run in parallel, in combination, in loops, or in any order.

At step 202, the method 200 involves determining a level of accumulation of a hydrocarbon-water emulsion in an annulus of a wellbore. The wellbore is, for example, the primary wellbore 108, and the annulus is, for example, annulus 112 of FIG. 1. In some examples, the hydrocarbon-water emulsion is produced by the horizontal wellbore 110 of FIG. 1.

At step 204, the method 200 involves based on the level of accumulation, determining an operating setting of a hydrocarbon-water separator and operating the hydrocarbon-water separator at the operating setting, where the hydrocarbon-water separator separates the hydrocarbon-water emulsion into water and a hydrocarbon fluid. In some examples, the hydrocarbon-water separator is the hydrocarbon-water separator 104 of FIG. 1, where the hydrocarbon-water separator includes a compartment for gravity separation and at least one of a heating element 126 or an emulsifier injection line 128.

At step 206, the method 200 involves activating, in response to a first sensor detecting a first water level in the annulus, a pump that pumps the water from the annulus into a water zone below the wellbore. In some examples, the first sensor is the upper sensor 134*a*, the pump is the ESP 132, and the water zone is the water zone 118.

At step 208, the method 200 involves deactivating the pump in response to a second sensor detecting a second water level in the annulus, where the second sensor is located below the first sensor. In some examples, the second sensor is the lower sensor 134*b*.

In some implementations, the hydrocarbon-water separator includes a heating element, and the operating setting is a temperature of the heating element.

In some implementations, the hydrocarbon-water separator includes a heating element, and the operating setting is a length of time that the heating element is turned on.

In some implementations, the hydrocarbon-water separator includes a demulsifier injection line, and the operating setting comprises a quantity of chemicals injected by the emulsion injection line. The emulsion injection line may run to a tank on the surface that includes the chemicals, and can be controlled to intermittently or continuously inject chemicals, such as demulsifiers and flocculants.

In some implementations, determining the operating setting of the hydrocarbon-water separator is further based on a rate of separation of the hydrocarbon-water emulsion.

In some implementations, the rate of separation is calculated based on at least one of a quantity of emulsion that enters the annulus and a quantity of hydrocarbon fluid that reaches the surface during a given time period.

In some implementations, the pump comprises an electric submersible pump.

Figure 3:
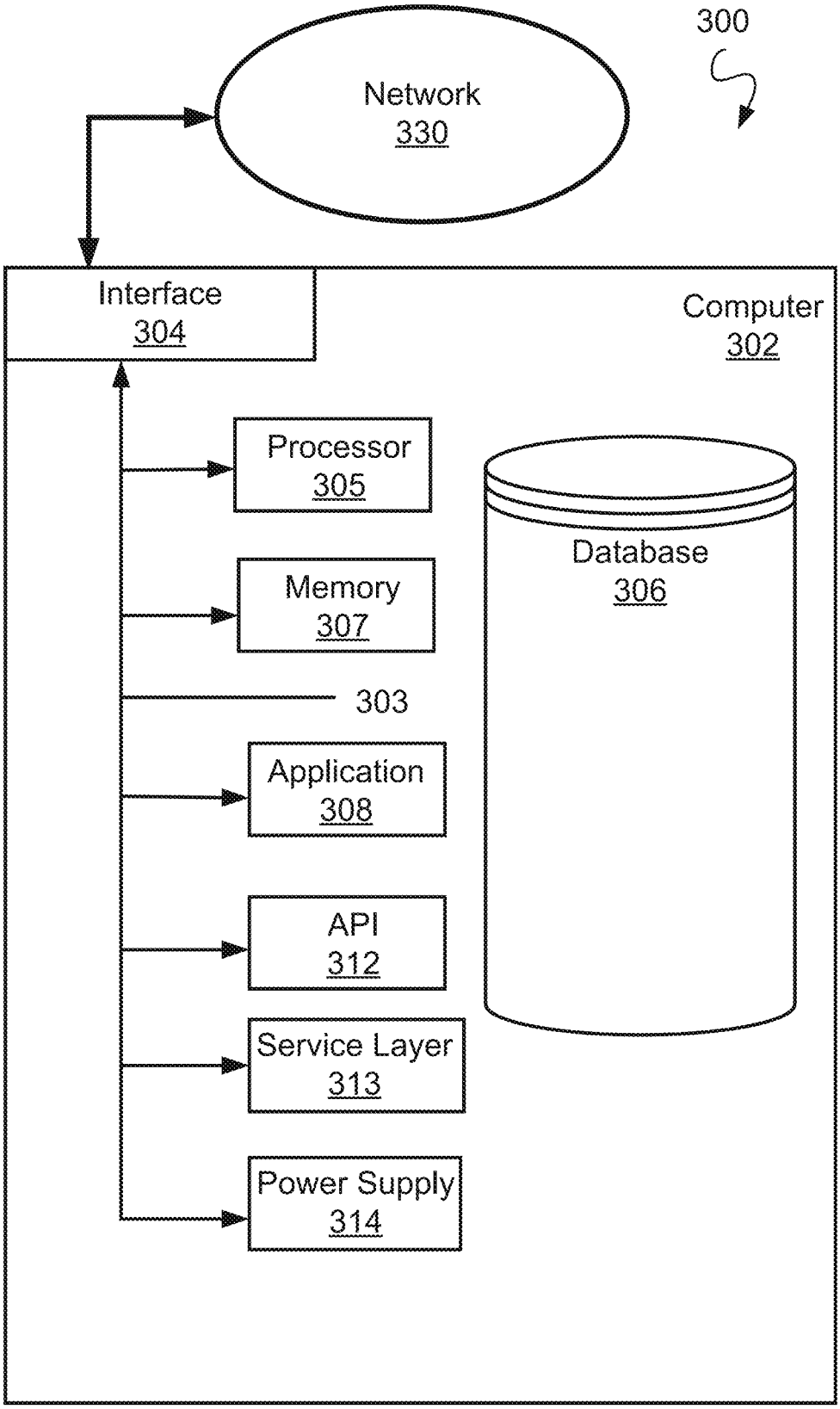
FIG. 3 is a block diagram of an example computer system, according to some implementations of the present disclosure.

FIG. 3 is a block diagram of an example computer system 300 that can be used to provide computational functionalities associated with described algorithms, methods, functions, processes, flows, and procedures, according to some implementations of the present disclosure.

The illustrated computer 302 is intended to encompass any computing device such as a server, a desktop computer, an embedded computer, a laptop/notebook computer, a wireless data port, a smart phone, a personal data assistant (PDA), a tablet computing device, or one or more processors within these devices, including physical instances, virtual instances, or both. The computer 302 can include input devices such as keypads, keyboards, and touch screens that can accept user information. Also, the computer 302 can include output devices that can convey information associated with the operation of the computer 302. The information can include digital data, visual data, audio information, or a combination of information. The information can be presented in a graphical user interface (UI) (or GUI). In some implementations, the inputs and outputs include display ports (such as DVI-I+2× display ports), USB 3.0, GbE ports, isolated DI/O, SATA-III (6.0 Gb/s) ports, mPCIe slots, a combination of these, or other ports. In instances of an edge gateway, the computer 302 can include a Smart Embedded Management Agent (SEMA), such as a built-in ADLINK SEMA 2.2, and a video sync technology, such as Quick Sync Video technology supported by ADLINK MSDK+. In some examples, the computer 302 can include the MXE-5400 Series processor-based fanless embedded computer by ADLINK, though the computer 302 can take other forms or include other components.

The computer 302 can serve in a role as a client, a network component, a server, a database, a persistency, or components of a computer system for performing the subject matter described in the present disclosure. The illustrated computer 302 is communicably coupled with a network 330. In some implementations, one or more components of the computer 302 can be configured to operate within different environments, including cloud-computing-based environments, local environments, global environments, and combinations of environments.

At a high level, the computer 302 is an electronic computing device operable to receive, transmit, process, store, and manage data and information associated with the described subject matter. According to some implementations, the computer 302 can also include, or be communicably coupled with, an application server, an email server, a web server, a caching server, a streaming data server, or a combination of servers.

The computer 302 can receive requests over network 330 from a client application (for example, executing on another computer 302). The computer 302 can respond to the received requests by processing the received requests using software applications. Requests can also be sent to the computer 302 from internal users (for example, from a command console), external (or third) parties, automated applications, entities, individuals, systems, and computers.

Each of the components of the computer 302 can communicate using a system bus. In some implementations, any or all of the components of the computer 302, including hardware or software components, can interface with each other or the interface 304 (or a combination of both), over the system bus. Interfaces can use an application programming interface (API) 312, a service layer 313, or a combination of the API 312 and service layer 313. The API 312 can include specifications for routines, data structures, and object classes. The API 312 can be either computer-language independent or dependent. The API 312 can refer to a complete interface, a single function, or a set of APIs 312.

The service layer 313 can provide software services to the computer 302 and other components (whether illustrated or not) that are communicably coupled to the computer 302. The functionality of the computer 302 can be accessible for all service consumers using this service layer 313. Software services, such as those provided by the service layer 313, can provide reusable, defined functionalities through a defined interface. For example, the interface can be software written in JAVA, C++, or a language providing data in extensible markup language (XML) format. While illustrated as an integrated component of the computer 302, in alternative implementations, the API 312 or the service layer 313 can be stand-alone components in relation to other components of the computer 302 and other components communicably coupled to the computer 302. Moreover, any or all parts of the API 312 or the service layer 313 can be implemented as child or sub-modules of another software module, enterprise application, or hardware module without departing from the scope of the present disclosure.

The computer 302 can include an interface 304. Although illustrated as a single interface 304 in FIG. 3, two or more interfaces 304 can be used according to particular needs, desires, or particular implementations of the computer 302 and the described functionality. The interface 304 can be used by the computer 302 for communicating with other systems that are connected to the network 330 (whether illustrated or not) in a distributed environment. Generally, the interface 304 can include, or be implemented using, logic encoded in software or hardware (or a combination of software and hardware) operable to communicate with the network 330. More specifically, the interface 304 can include software supporting one or more communication protocols associated with communications. As such, the network 330 or the interface's hardware can be operable to communicate physical signals within and outside of the illustrated computer 302.

The computer 302 includes a processor 305. Although illustrated as a single processor 305 in FIG. 3, two or more processors 305 can be used according to particular needs, desires, or particular implementations of the computer 302 and the described functionality. Generally, the processor 305 can execute instructions and manipulate data to perform the operations of the computer 302, including operations using algorithms, methods, functions, processes, flows, and procedures as described in the present disclosure.

The computer 302 can also include a database 306 that can hold data for the computer 302 and other components connected to the network 330 (whether illustrated or not). For example, database 306 can be an in-memory, conventional, or a database storing data consistent with the present disclosure. In some implementations, the database 306 can be a combination of two or more different database types (for example, hybrid in-memory and conventional databases) according to particular needs, desires, or particular implementations of the computer 302 and the described functionality. Although illustrated as a single database 306 in FIG. 3, two or more databases (of the same, different, or combination of types) can be used according to particular needs, desires, or particular implementations of the computer 302 and the described functionality. While database 306 is illustrated as an internal component of the computer 302, in alternative implementations, database 306 can be external to the computer 302.

The computer 302 also includes a memory 307 that can hold data for the computer 302 or a combination of components connected to the network 330 (whether illustrated or not). Memory 307 can store any data consistent with the present disclosure. In some implementations, memory 307 can be a combination of two or more different types of memory (for example, a combination of semiconductor and magnetic storage) according to particular needs, desires, or particular implementations of the computer 302 and the described functionality. Although illustrated as a single memory 307 in FIG. 3, two or more memories 307 (of the same, different, or combination of types) can be used according to particular needs, desires, or particular implementations of the computer 302 and the described functionality. While memory 307 is illustrated as an internal component of the computer 302, in alternative implementations, memory 307 can be external to the computer 302.

An application 308 can be an algorithmic software engine providing functionality according to particular needs, desires, or particular implementations of the computer 302 and the described functionality. For example, an application 308 can serve as one or more components, modules, or applications 308. Multiple applications 308 can be implemented on the computer 302. Each application 308 can be internal or external to the computer 302.

The computer 302 can also include a power supply 314. The power supply 314 can include a rechargeable or non-rechargeable battery that can be configured to be either user- or non-user-replaceable. In some implementations, the power supply 314 can include power-conversion and management circuits, including recharging, standby, and power management functionalities. In some implementations, the power-supply 314 can include a power plug to allow the computer 302 to be plugged into a wall socket or a power source to, for example, power the computer 302 or recharge a rechargeable battery.

There can be any number of computers 302 associated with, or external to, a computer system including computer 302, with each computer 302 communicating over network 330. Further, the terms "client", "user", and other appropriate terminology can be used interchangeably without departing from the scope of the present disclosure. Moreover, the present disclosure contemplates that many users can use one computer 302 and one user can use multiple computers 302.

Implementations of the subject matter and the functional operations described in this specification can be implemented in digital electronic circuitry, in tangibly embodied computer software or firmware; in computer hardware, including the structures disclosed in this specification and their structural equivalents; or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus", "computer", and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus and special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, Linux, Unix, Windows, Mac OS, Android, or iOS.

A computer program, which can also be referred to or described as a program, software, a software application, a module, a software module, a script, or code can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document; in a single file dedicated to the program in question; or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes; the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks, optical memory devices, and technologies including, for example, digital video disc (DVD), CD ROM, DVD+/−R, DVD-RAM, DVD-ROM, HD-DVD, and BLURAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), or a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface", or "GUI", can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component such as an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, or in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations; and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A downhole tool disposed in a wellbore, comprising:

a hydrocarbon-water separator that separates a hydrocarbon-water emulsion received from a subterranean formation into water and a hydrocarbon fluid, wherein the hydrocarbon fluid flows through a first plurality of holes in a production tubing of the wellbore;

a pump defining an inlet and an outlet, wherein the inlet is aligned with a second plurality of holes in the production tubing, the second plurality of holes longitudinally separated from the first plurality of holes, and the outlet oriented perpendicular to the second plurality of holes; and a first sensor and a second sensor located between the first plurality of holes and the second plurality of holes, the first sensor configured to activate the pump when a first water level is detected in the wellbore, and the second sensor configured to deactivate the pump when a second water level is detected in the wellbore.

2. The downhole tool of claim 1, wherein the hydrocarbon-water separator comprises a compartment in which the hydrocarbon-water emulsion accumulates, and wherein gravity causes the hydrocarbon-water emulsion to separate when the hydrocarbon-water emulsion is in a non-turbulent state.

3. The downhole tool of claim 1, wherein the hydrocarbon-water separator comprises a heating element disposed in a compartment in which the hydrocarbon-water emulsion accumulates, the heating element configured to heat the hydrocarbon-water emulsion to an effective separation temperature.

4. The downhole tool of claim 1, wherein the hydrocarbon-water separator comprises a demulsifier injection line disposed in a compartment in which the hydrocarbon-water emulsion accumulates, the demulsifier injection line configured to inject at least one of a demulsifier or a flocculant into the compartment.

5. The downhole tool of claim 4, wherein the compartment is an annulus of the wellbore.

6. The downhole tool of claim 1, wherein the production tubing, a first packer, and a second packer form a wellbore annulus when engaged with a downhole casing of the wellbore.

7. The downhole tool of claim 1, further comprising:

a porous housing defining an inner volume; and a floatable object, wherein the floatable object, the first sensor, and the second sensor are located within the inner volume, and the first sensor and the second sensor respectively detect the first water level and the second water level by detecting contact with the floatable object.

8. The downhole tool of claim 1, wherein the pump comprises an electric submersible pump.

9. A method comprising:

determining a level of accumulation of a hydrocarbon-water emulsion in an annulus of a wellbore;

based on the level of accumulation, determining an operating setting of a hydrocarbon-water separator and operating the hydrocarbon-water separator at the operating setting, wherein the hydrocarbon-water separator separates the hydrocarbon-water emulsion into water and a hydrocarbon fluid;

activating, in response to a first sensor detecting a first water level in the annulus, a pump that pumps the water from the annulus into a water zone below the wellbore; and deactivating the pump in response to a second sensor detecting a second water level in the annulus, wherein the second sensor is located below the first sensor.

10. The method of claim 9, wherein the hydrocarbon-water separator comprises a heating element, and wherein the operating setting is a temperature of the heating element.

11. The method of claim 9, wherein the hydrocarbon-water separator comprises a heating element, and wherein the operating setting is a length of time that the heating element is turned on.

12. The method of claim 9, wherein the hydrocarbon-water separator comprises a demulsifier injection line, and wherein the operating setting comprises a quantity of chemicals injected by the demulsifier injection line.

13. The method of claim 9, wherein determining the operating setting of the hydrocarbon-water separator is further based on a rate of separation of the hydrocarbon-water emulsion.

14. The method of claim 13, wherein the rate of separation is calculated based on at least one of a quantity of emulsion that enters the annulus and a quantity of hydrocarbon fluid that reaches the surface during a given time period.

15. The method of claim 9, wherein the pump comprises an electric submersible pump.

16. A wellbore system, comprising:

a hydrocarbon-water separator that is configured to separate a hydrocarbon-water emulsion received from a subterranean formation into water and a hydrocarbon fluid;

a pump defining an inlet and an outlet; and a first sensor and a second sensor that are vertically separated, the first sensor configured to activate the pump when a first water level is detected in an annulus of the wellbore system, and the second sensor configured to deactivate the pump when a second water level is detected in the annulus;

one or more processors; and a non-transitory computer-readable storage medium coupled to the one or more processors and storing programming instructions for execution by the one or more processors, the programming instructions instructing the one or more processors to perform operations comprising:

determining a level of accumulation of a hydrocarbon-water emulsion in the annulus;

based on the level of accumulation, determining an operating setting of the hydrocarbon-water separator and operating the hydrocarbon-water separator at the operating setting;

activating, in response to the first sensor detecting the first water level in the annulus, the pump to pump the water from the annulus into a water zone below the wellbore system; and deactivating the pump in response to the second sensor detecting the second water level in the annulus, wherein the second sensor is located below the first sensor.

17. The wellbore system of claim 16, further comprising:

a porous housing defining an inner volume; and a floatable object, wherein the floatable object, the first sensor, and the second sensor are located within the inner volume, and the first sensor and the second sensor respectively detect the first water level and the second water level by detecting contact with the floatable object.

18. The wellbore system of claim 16, wherein determining the operating setting of the hydrocarbon-water separator is further based on a rate of separation of the hydrocarbon-water emulsion.

19. The wellbore system of claim 16, wherein the pump comprises an electric submersible pump.

* * * * *